US010292215B1

(12) United States Patent
Liu et al.

(10) Patent No.: US 10,292,215 B1
(45) Date of Patent: May 14, 2019

(54) ELONGATED LAMP TUBE, BALLAST AND KIT THEREOF

(71) Applicant: XIAMEN ECO LIGHTING CO. LTD., Xiamen (CN)

(72) Inventors: Qi Liu, Xiamen (CN); Qiyuan Wang, Xiamen (CN); Zongyan Liu, Xiamen (CN); Cantian Wu, Xiamen (CN); Wei Liu, Xiamen (CN); Yongjun Bao, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 15/949,031

(22) Filed: Apr. 9, 2018

(30) Foreign Application Priority Data

Mar. 26, 2018 (CN) ..... 2018 1 0253371

(51) Int. Cl.

| | |
|---|---|
| ***H05B 33/08*** | (2006.01) |
| ***F21V 23/02*** | (2006.01) |
| ***F21K 9/275*** | (2016.01) |
| ***F21V 15/015*** | (2006.01) |
| ***F21K 9/278*** | (2016.01) |
| ***F21V 25/10*** | (2006.01) |
| ***F21K 9/272*** | (2016.01) |
| *F21Y 115/10* | (2016.01) |

(52) U.S. Cl.
CPC ..... *H05B 33/0809* (2013.01); *F21K 9/272* (2016.08); *F21K 9/275* (2016.08); *F21K 9/278* (2016.08); *F21V 15/015* (2013.01); *F21V 23/02* (2013.01); *F21V 25/10* (2013.01); *F21Y 2115/10* (2016.08)

(58) Field of Classification Search
CPC ..... F21Y 2115/10; F21Y 2105/00; F21Y 2115/15; F21K 9/278; F21K 9/275; F21K 9/20; F21K 9/27; F21K 9/60; F21V 23/009; F21V 23/02; F21V 23/023; F21V 19/008; F21V 23/00; H05B 33/0815; H05B 33/0803; H05B 33/0806; H05B 33/0887; H05B 33/0884; H05B 37/02; Y02B 20/386; F21S 4/28
See application file for complete search history.

(56) References Cited

U.S. PATENT DOCUMENTS

| | | | | |
|---|---|---|---|---|
| 8,096,683 | B1 * | 1/2012 | Burrell, IV | F21V 19/0045 362/223 |
| 9,277,603 | B2 * | 3/2016 | Hsia | F21V 25/04 |
| 9,288,867 | B2 * | 3/2016 | Hsia | H05B 33/0884 |
| 9,781,805 | B2 * | 10/2017 | Xiong | H05B 33/0887 |
| 9,897,265 | B2 * | 2/2018 | Xiong | F21K 9/278 |
| 2017/0370534 | A1 * | 12/2017 | Xiong | F21V 3/061 |
| 2018/0112837 | A1 * | 4/2018 | Sadwick | F21K 9/27 |

* cited by examiner

*Primary Examiner* — Vibol Tan
(74) *Attorney, Agent, or Firm* — Chun-Ming Shih

(57) ABSTRACT

An elongated lamp tube has an elongated tube shell, two caps, a LED light source, a first power supply circuit, a second power supply circuit and a frequency switch circuit. The elongated lamp tube may be connected to first electrodes of a lamp fixture without a ballast or a lamp fixture with a ballast. The ballast converts an external power of an industrial frequency to a converted power of a working frequency. The frequency switch circuit is connected to the first power supply and the second power supply for blocking one of the first power supply circuit and the second power supply to supply driving current to the LED light source according to an input frequency of a received power.

14 Claims, 4 Drawing Sheets

ELONGATED LAMP TUBE, BALLAST AND KIT THEREOF

TECHNICAL FIELD

The present invention is related to an elongated lamp tube and more particularly related to an elongated lamp tube in a light fixture with a ballast.

BACKGROUND

Various elongated lamp tubes are widely used in human life. First, fluorescent lamp tubes are developed and quickly spread over the world. When LED (Light Emitted Diode) technologies are developed, due to high luminous efficacy and long life span, there is a trend to replace LED lamp tubes with traditional fluorescent lamp tubes.

For traditional lamp tubes, there are kinds of ballast to help fluorescent lamp tubes work normally. In one ballast type, 120V-277V of industrial frequency like 50 Hz or 60 Hz is converted to a high working frequency, like 45 KHz or a frequency higher than 20 KHz.

LED lamp tubes and their LED modules do not need such ballast to function normally. However, because most environment already install lamp fixture compatible of traditional fluorescent lamp tubes, it would be important for LED lamp tubes to be compatible with these lamp fixture designed originally for fluorescent lamp tubes.

On solving this technical problem, it would be beneficial to consider various existed standards, like a common light fixture standard, UL standard in North America area. By discovering a flexible technical solution, great convenience, including stocking cost, may be greatly reduced accordingly, particularly in such crowded art involving great amount of products worldwide.

SUMMARY OF INVENTION

According to an embodiment of the present invention, an elongated lamp tube has an elongated tube shells, two caps, a LED light source, a first power supply circuit, a second power supply circuit and a frequency switch circuit.

The elongated tube shell has a containing space and two shell ends.

The two caps are respectively fixed to the two shell ends. The two caps have tube electrodes capable of being electrically connecting to first electrodes of a first type lamp fixture without a ballast or second electrodes of a second type lamp fixture with a ballast. In other words, the elongated lamp may be installed on a lamp fixture with a ballast or on a lamp fixture without a ballast.

In current lamp fixture standards, like UL standard in North America area, the lamp tubes need to have different driving circuit designs for lamp fixtures with and without ballast. In such case, manufacturers need to produce at least two types of lamp tubes, which may cause a heavy burden on stocking and also cause inconvenience of users because users may buy lamp tubes not compatible with their lamp fixtures.

The elongated lamp tube of this embodiment fits in both types of lamp fixture, i.e. with ballast or without ballast.

There are various types of ballast and most of ballast devices convert an external power of an industrial frequency to a converted power of a working frequency higher than a frequency of the external power. For example, a 120V-277V external source with 50 Hz or 60 Hz industrial frequency commonly available in daily life may be supplied to a ballast. The ballast converts the received power to a power with a working frequency like 45 KHz or others higher than 20 KHz that higher than industrial frequency like 50 Hz. The lamp tube driver circuit then needs to handle the converted power with higher frequency.

In other words, there may be two types of input power. First type of power would be raw power input of 120V-277V with 50 Hz or 60 Hz, while the second type of power would be converted power by a ballast with working frequency like 45 KHz or a frequency higher than 20 KHz. The elongated lamp tube is compatible of receiving any of the two kinds of input power.

The LED light source emits light passing through a tube surface of the elongated tube shell. The tube surface for emitting light may be 360 degrees or less degrees. For example, 120 degrees of the tube shell may be disposed with a reflector while keeping 240 degrees of tube surface transparent or translucent for light to passing through to increase overall luminous efficacy.

The first power supply circuit converts the converted power of the working frequency to a first driving current supplying to the LED light source. In other words, the first power supply circuit helps to process power supply preprocessed by a ballast.

On the other hand, the second power supply circuit converts the external power of the industrial frequency to a second driving current to the LED light source, e.g. to process input power not handled by a ballast but from a raw power source.

In addition, the frequency switch circuit is connected to the first power supply and the second power supply for blocking one of the first power supply circuit and the second power supply to supply one of the first driving current and the second driving current to the LED light source according to an input frequency of a received power from the tube electrodes.

Specifically, the frequency switch circuit detects the frequency of the input power. By detecting and functioning different according to different frequencies, the frequency switch the first power supply circuit or the second power supply circuit to function. For example, the frequency switch may turn on the first power supply circuit and turn off the second power supply circuit to handle a power input previously processed by a ballast. The frequency switch may turn on the second power supply circuit and turn off the first power supply circuit to handle a power input not handled by a ballast but supplied directly from an indoor electricity power source.

The first power supply circuit, the second power supply circuit, and the detector are stored in the containing space for an elongated tube module.

In some embodiments, the frequency switch circuit may include a capacitor for blocking the received power into the first power supply circuit when the input frequency of the received power is within a predetermined range of the industrial frequency.

Capacitor components have a feature to block a signal when the signal is at a low frequency, e.g. 50 Hz, while passing the signal through if the signal is at a high frequency, e.g. more than like 45 KHz or a frequency higher than 20 KHz. For example, a capacitor of thin film capacitor with about 4.7 nF may be used. Other configuration or devices may be used if such components or circuit combination helps substantially passing through a signal in a first frequency range while substantially blocking a signal in a second frequency range.

In some embodiments, the frequency switch circuit may further include a voltage switch for supplying a voltage signal to the second power supply circuit to disable working of the second power supply circuit.

For example, the voltage switch may be an optical coupled switch connected to the first power supply circuit. The voltage switch is enabled when the first power supply is activated by receiving the received power. When the voltage switch is enabled, the voltage switch connects to a ground and may send a ground voltage to a power supply integrated chip of the second power supply circuit to disable working of the power supply integrated chip. In such case, since the second power supply circuit relies on the power supply integrated chip to generate a driving current to the LED light source, setting a pin of the power supply integrated chip with a ground voltage may disable function of the power supply integrated chip, thus blocking the function of the second power supply circuit, remaining only the first power supply circuit to drive the LED light source to emit light.

Please be noted that when an integrated chip is used, the signal sent to the integrated chip for disabling the integrated chip may be differently defined, e.g. not as a ground voltage but a 5V signal or other signal pattern. With such configuration, a corresponding adjustment to the frequency switch should be conducted accordingly, which would be understood by persons of ordinary skilled in the art and not repeated here for brevity.

In some embodiments, the elongated lamp tube may further include a safety circuit connected for turning off the second power supply circuit by detecting an impedance of tube electrodes. With such safety circuit, even users accidently touch the electrodes, users may not be hurt by high voltage electricity shock.

In some embodiments, the elongated lamp tube may further include a temperature fuss for escaping the first power supply circuit and the second power supply circuit from the received power if a temperature at the temperature fuss is higher than a predetermined threshold. For example, when there is any abnormal situation occurred, the temperature at the temperature fuss is quickly increased, and the temperature fuss may be disconnected, e.g. two metal clips, to prevent certain risk to happen.

In some embodiments, the elongated lamp tube may further include a tube detection module of resistors to be compatible with different types of ballast. Since there are various ballast design, such tube detection module composed of resistors may help ensure compatibility of the elongated lamp tube.

In some embodiments, the elongated lamp tube may further include a piezo-resistor for escaping the second power supply module from the received power when the received power is abnormal. For example, when sudden increasing voltage or current occurs the piezo-resistor may disconnect the circuit to prevent undesired risk.

In some embodiments, the first power supply circuit may have a first filter circuit for further filtering a bridge current generated by a bridge circuit to generate the first driving current to the LED light source. It is common to use a bridge circuit to convert alternating current to a direct current to drive LED modules. To further enhance stability of the driving current, a first filter circuit may be used to provide a more stable and less varied current, which may enhance overall light characteristic and enhance life span of LED modules.

In some embodiments, the first filter circuit may be made by combining a capacitor and a resistor connected in parallel with the LED light source.

In some embodiments, the second power supply circuit may have a second filter circuit with a conductor, a resistor and capacitors for lowering an electro-magnetic wave of the elongated lamp tube. When an alternating power source is used, it is important to prevent or at least lower down unnecessary electro-magnetic wave to satisfy various EMC standards particularly for light devices widely and frequently used in human life.

In some embodiments, the elongated lamp tube is compatible of replacing a fluorescent tube under Underwriters Laboratories (UL) standard. In other words, the elongated lamp tube as described is very suitable for replacing traditional UL fluorescent tubes both for lamp fixtures with or without ballast devices.

In some embodiments, the first power supply circuit, the second power supply circuit and the frequency switch circuit are stored in one of the caps. As mentioned above, the first power supply circuit, the second power supply circuit, the frequency switch circuit and the LED light source are stored in the containing space of the tube shell. Furthermore, the two caps attached at two opposing ends of the tube shells may provide a place even better for storing the first power supply circuit, the second power supply circuit and the frequency switch circuit. These circuits may be partly stored in one cap and partly in the other cap, or all stored in one of the caps.

In some embodiments, the industrial frequency mentioned above is between 30 to 70 Hz. In addition, the working frequency of the ballast may be like 45 KHz or a frequency higher than 20 KHz.

In some embodiments, the ballast is an electronic ballast. Please be noted that other ballast type may also be used. The electronical ballast for converting input power to a high frequency is particularly fitting to the embodiment.

In another embodiment series, a ballast may be designed. The ballast is designed to work with a lamp fixture to be installed with an elongated lamp tube. The elongated lamp tube includes an elongated tube shell having a containing space and two shell ends, two caps respectively fixed to the two shell ends, the two caps having tube electrodes, a LED light source for emitting light passing through a tube surface of the elongated tube shell, and a second power supply circuit. The ballast has a housing, electrodes and a wire.

The housing may be similar to traditional ballast under various standards. The electrodes are disposed on the housing compatible with ballast electrodes under UL standard for receiving a power of an industrial frequency. The wire in the housing is provided for routing the power of the industrial frequency to the tube electrodes electrically connected to the second power supply circuit without changing the industrial frequency of the power. In other words, the ballast does not work like traditional ballast devise. Instead the ballast may simply pass the input power to the elongated lamp tube as described above, since such elongated lamp has a second power supply circuit capable of processing raw power input, 120V-277V power with 50 Hz or 60 Hz.

Still, by using the ballast, the elongated lamp tube, originally may not fit the lamp fixture with a ballast, now works normally with such lamp fixture. Since such elongated lamp tube may handle raw power source of 120V-277V with 50 Hz or 60 Hz while still be compatible installed on a lamp fixture with a ballast, the first power supply circuit may exist or may not need to exist at the same time, since the second power supply circuit is sufficient in such case.

Even so, please be noted that the elongated lamp tube may still encompass the first power supply circuit and the frequency switch as mentioned above.

On making such embodiments as a product, the elongated lamp tube and the special ballast may be sold as a kit.

In such case, users may buy the kit home. When their old ballast still works, the elongated lamp tube may work well with the old ballast since the elongated lamp tube has the first power supply circuit. When the old ballast is out of order, the user may replace the old ballast with the special ballast as mentioned above and uses the elongated lamp tube directly since the elongated lamp tube has the second power supply circuit and the frequency switch circuit to automatically turn on the second power supply circuit to function normally.

In other words, these embodiments provide a convenient technical solutions for users no matter they user a lamp fixture with a ballast or without a ballast. This is even particularly helpful for manufacturers because overall stocking pressure is dramatically decreased with such compatibility.

DETAILED DESCRIPTION

Figure 1:
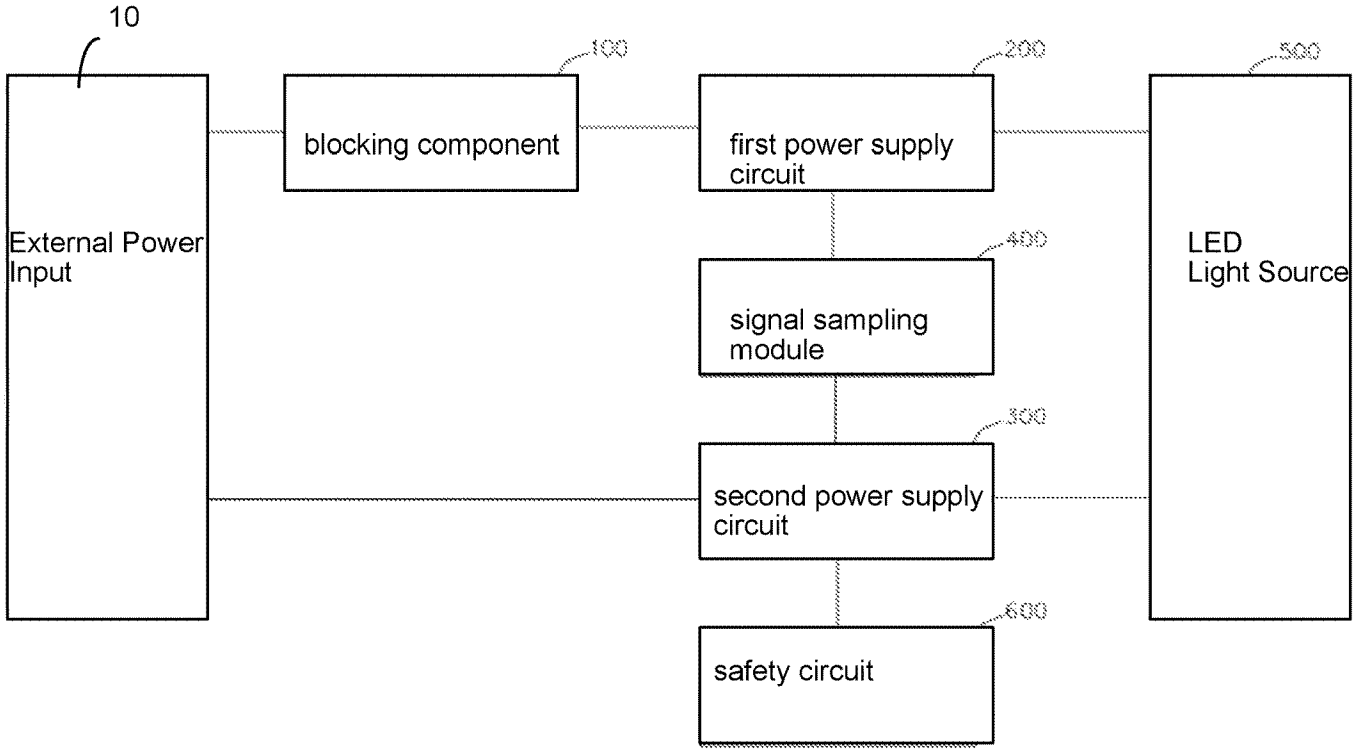
FIG. 1 is a diagram illustrating electrical connection of components in an elongated lamp tube embodiments.

Please refer to FIG. 1. FIG. 1 is a diagram illustrating electrical connection of components in an elongated lamp tube embodiments.

In FIG. 1, an external power input 10 is provided from a lamp fixture and the power input may be 120V-277V with an industrial frequency like 50 Hz or 60 Hz. The circuit diagram provides an electrical aspect of this embodiment.

When the external power input 10 is connected to the elongated lamp tube, there are two scenarios of the lamp fixture. In the first scenario, the lamp fixture has a ballast to convert external power source of 120V-277V with 50 Hz or 60 Hz to a high frequency power signal like 45 KHz or a frequency higher than 20 KHz.

In such scenario, the first power supply circuit 200 handles the high frequency power signal like 45 KHz or a frequency higher than 20 KHz and converts the power signal into a proper driving current supplying to the LED light source 500 to emit light.

In addition, the signal sampling module 400 may be activated and generates a control signal sent to the second power supply circuit 300 to turn off the second power supply circuit 300.

In other words, in such scenario, only the first power supply circuit 200 is working for providing a driving current to the LED light source 500.

In the second scenario, when there is no ballast for converting the external power input 10 into a power signal of high frequency as mentioned above, the blocking component 100 like one or more capacitors may be used for blocking the external power input flowing into the first power supply circuit 200. The signal sampling module 400 in such case is not activated because of not receiving a power supply, and thus does not send a disable command to the second power supply circuit 300 to turn off the second power supply circuit 300.

In such case, the second power supply circuit 300 helps converts raw power input of 120V-277V with 50 Hz or 60 Hz to a proper driving current to the LED light sourcing 500.

In addition, a safety circuit 600 may be designed for preventing users to get electrical shock during operation or preventing other risk to comply with safety standards.

Figure 2:
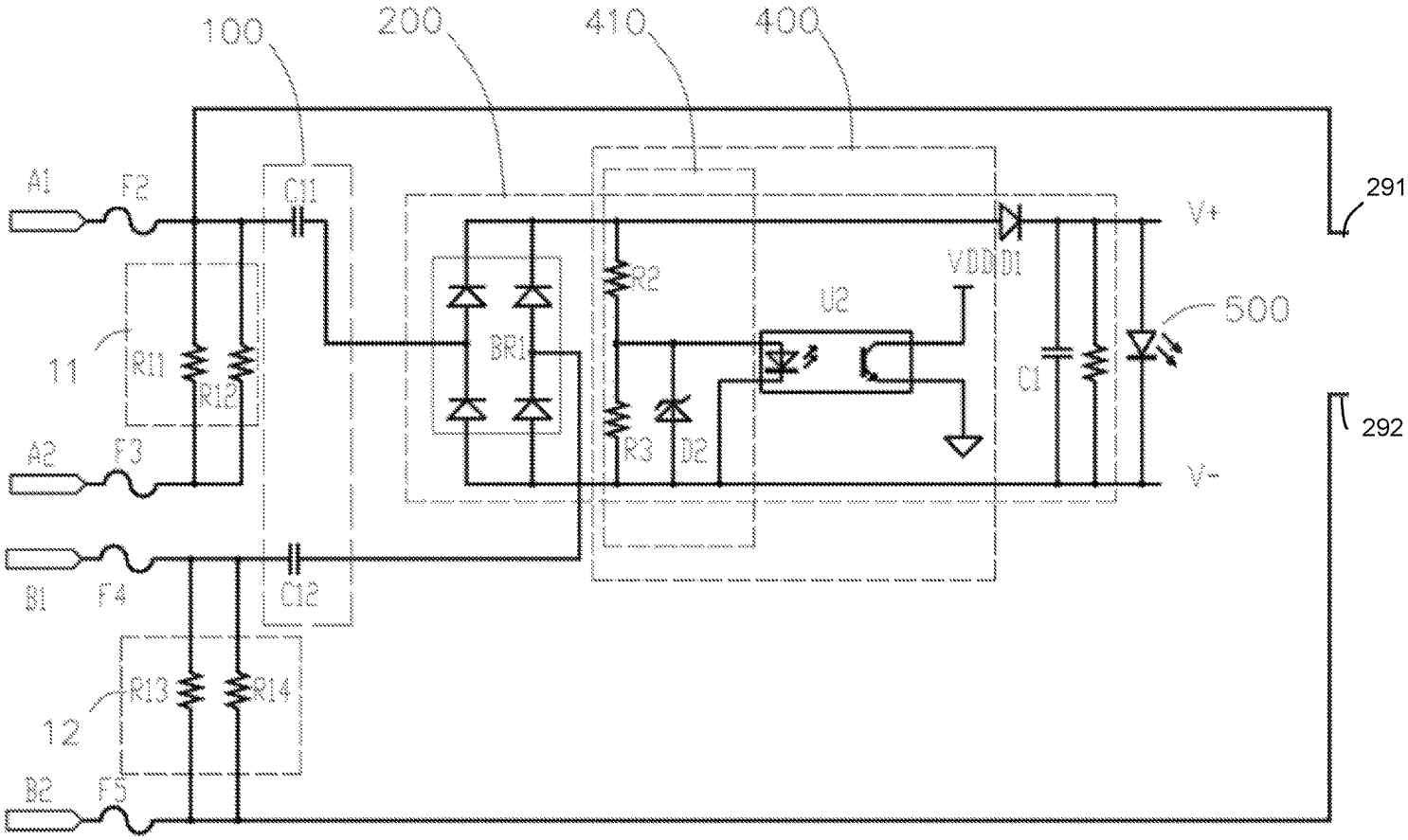
FIG. 2 is a detailed diagram of a first part of a circuit implementation example.
Figure 3:
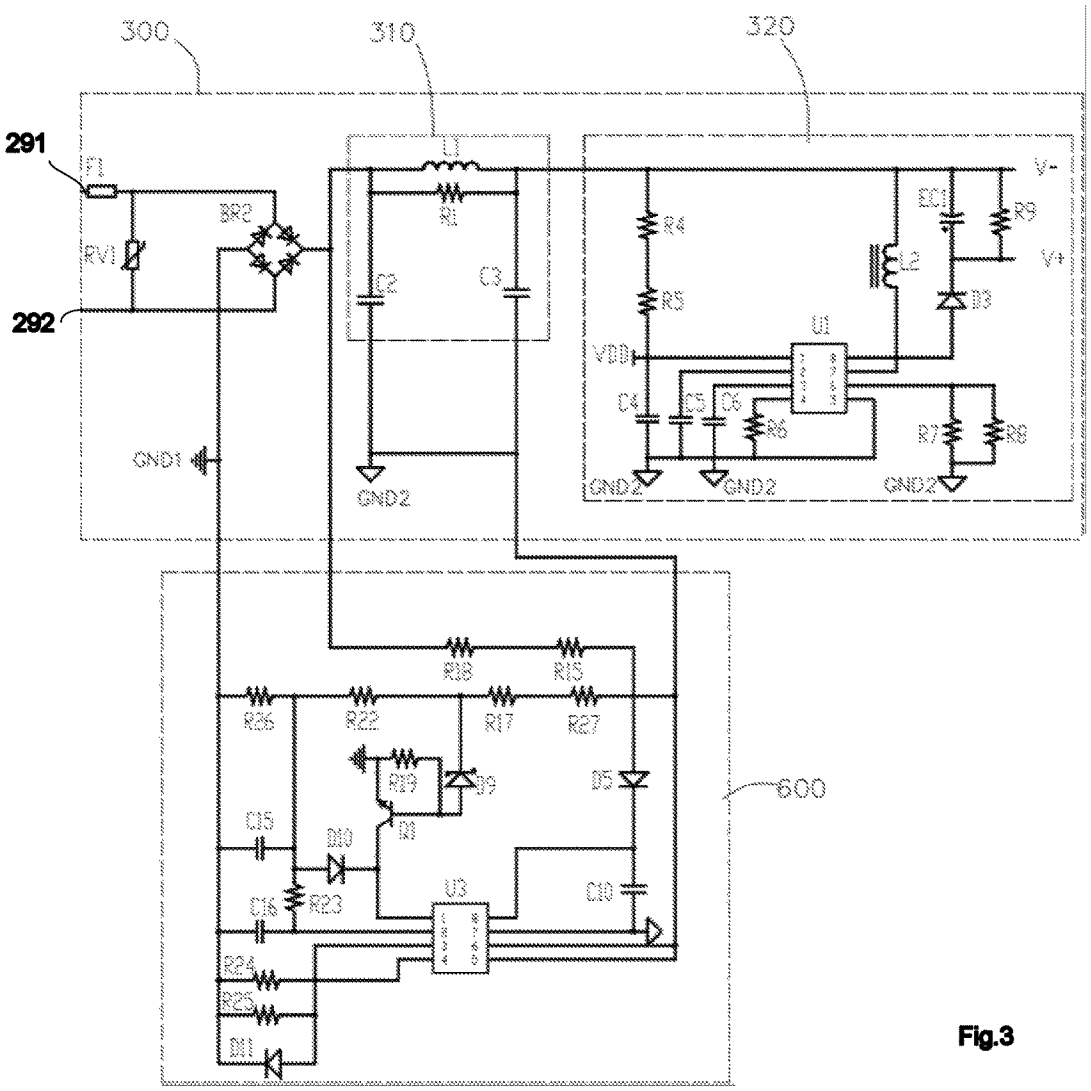
FIG. 3 is a detailed diagram of a second part of a circuit implementation example.

Next, please refer to FIG. 2 and FIG. 3. FIG. 2 is a detailed diagram of a first part of a circuit implementation example. FIG. 3 is a detailed diagram of a second part of a circuit implementation example. The reference numerals 291, 292 in FIG. 2 and FIG. 3 are connecting points to connect FIG. 2 and FIG. 3 as a compete circuit diagram.

Figure 4:
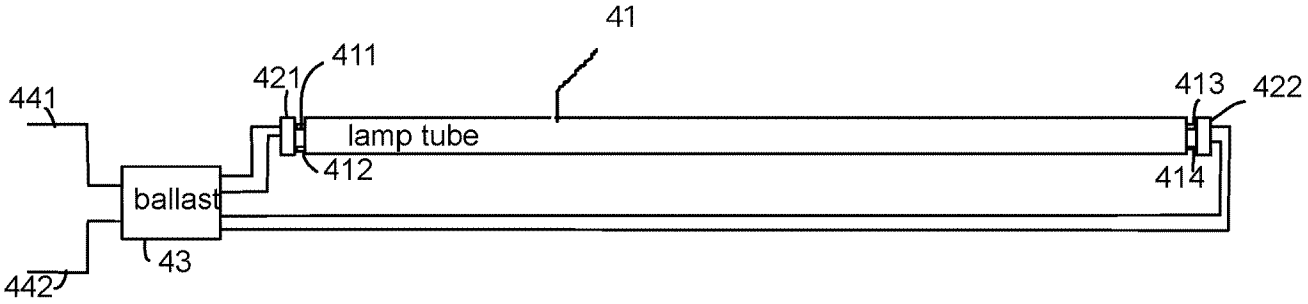
FIG. 4 is a diagram of an elongated lamp tube installed in a lamp fixture with a ballast.

First, the A1, A2 electrodes and the B1, B2 electrodes are respectively located at two opposite ends of an elongated lamp tube like an example illustrated in FIG. 4.

Four temperature fusses F2, F3, F4, F5 are connected to the electrodes A1, A2, B1 and B2. If temperature is abnormal at the temperature fusses F2, F3, F4, F5, these temperature fusses disconnect to protect the overall circuit from undesired risk.

Two tube detection modules 11, 12 composed of resistors R11, R12, R13, R14 are used to be compatible with different types of ballast.

Two capacitors C11, C12 are used as a blocking component 100 mentioned above. In other words, only power input with a high frequency like 2 KHz processed by a ballast may enter the first power supply circuit 200, e.g. the bridge circuit BR1 for converting an alternating current to a direct current. The converted power is passing through a diode D1 and filtered by a filter circuit of the capacitor C1 and a resistor to provide a stable direct current supplied to the LED light source 500.

The D1 prevents current to flowing into the optical coupling switch U2 when the second power supply circuit is in operation and the first power supply is blocked by capacitors mentioned above.

In addition, the signal sampling module 400 composed of the resistors R2, R3, the diode D2 and the optical coupling switch U2 also receives power supply. When the optical coupling switch U2 receives power and turns on, the ground voltage is connected to a VDD terminal connected to a VDD pin for disabling a power supply integrated chip U1 in FIG. 3.

In FIG. 3, the piezo-resistor RV1 is used for escaping the second power supply module from the received power when the received power is abnormal. The fuss resistor F1 is used for disconnect the circuit when abnormal power is detected.

As mentioned above, the second power supply circuit 300 are disabled when the frequency of the power input is detected as a high frequency, i.e. processed by an electronical ballast by setting the VDD pin as ground voltage level.

In other scenario, the first power supply circuit 200 is disabled with the blocking component and the second power supply circuit 300 is not disabled. Power input is converted by the bridge circuit BR2 to convert an alternating current to a direct current. The current generated by the bridge circuit BR2 is then filtered by the filter circuit of the conductor L1, the resistor R1, the capacitors C2, C3.

Then, a processing circuit module 320 has a power supply integrated chip U1 with corresponding components, R4, R5, C4, C5, C6, R6, L2, EC1, R9, D3, R7, R8 to generate a driving current to V+ and V− supplying to the LED light source 500.

In addition, a safety circuit with an integrated chip U3 and corresponding components R18, R15, R26, R22, R17, R27, C15, C16, R24, R25, D11, R23, D10, R19, Q1, D9, D5, C10 is used for detecting impedance. If abnormal impedance over a predetermined threshold is detected, the circuit is disconnected to prevent users to take electrical shock.

Please be noted that FIG. 2 and FIG. 3 only serves for examples and persons of ordinary skilled in the art may replace these illustrated circuits with any other components or circuit combination once they achieve the same functions as explained above.

FIG. 4 is a diagram of an elongated lamp tube installed in a lamp fixture with a ballast.

Two external power inputs 441, 442 receive 110V or 220V with 50 Hz or 60 Hz. In FIG. 4, the external power is first passing a ballast 43. The ballast 43 converts the external power into a power signal of high frequency. The power signal is provided to the lamp tube 41 from an electrodes 421, 422 to four electrodes 411, 412, 413, 414 of the lamp tube 41.

In other words, such lamp fixture is also designed for traditional fluorescent lamp tubes. As mentioned above, the elongated lamp tube may be directly fit in such lamp fixture because the first power supply circuit is capable of processing a power signal generated by a ballast 43 having a high frequency.

On the other hand, even the lamp fixture does not have the ballast, the elongated lamp tube may still be used because of the second power supply circuit.

In addition, a special ballast for directly routing input to the lamp tube 41 may be provided. Since the elongated lamp tube of the present invention may handle external power source of 120V-277V with 50 Hz or 60 Hz, the routed power by the special ballast may still make the elongated lamp tube function normally and users do not need to change any electrical setting the lamp fixture.

In other words, the special ballast may be sold with the elongated lamp tube as a kit for users to provide a convenient and flexible solution to work in most cases.

According to an embodiment of the present invention, an elongated lamp tube has an elongated tube shells, two caps, a LED light source, a first power supply circuit, a second power supply circuit and a frequency switch circuit.

The elongated tube shell has a containing space and two shell ends.

The two caps are respectively fixed to the two shell ends. The two caps have tube electrodes capable of being electrically connecting to first electrodes of a first type lamp fixture without a ballast or second electrodes of a second type lamp fixture with a ballast. In other words, the elongated lamp may be installed on a lamp fixture with a ballast or on a lamp fixture without a ballast.

In current lamp fixture standards, like UL standard in North America area, the lamp tubes need to have different driving circuit designs for lamp fixtures with and without ballast. In such case, manufacturers need to produce at least two types of lamp tubes, which may cause a heavy burden on stocking and also cause inconvenience of users because users may buy lamp tubes not compatible with their lamp fixtures.

The elongated lamp tube of this embodiment fits in both types of lamp fixture, i.e. with ballast or without ballast.

There are various types of ballast and most of ballast devices convert an external power of an industrial frequency to a converted power of a working frequency higher than a frequency of the external power. For example, a 120V-277V external source with 50 Hz or 60 Hz industrial frequency commonly available in daily life may be supplied to a ballast. The ballast converts the received power to a power with a working frequency like 45 KHz or a frequency higher than 20 KHz higher than industrial frequency like 50 Hz. The lamp tube driver circuit then needs to handle the converted power with higher frequency.

In other words, there may be two types of input power. First type of power would be raw power input of 120V-277V with 50 Hz or 60 Hz, while the second type of power would be converted power by a ballast with working frequency like 45 KHz or a frequency higher than 20 KHz. The elongated lamp tube is compatible of receiving any of the two kinds of input power.

The LED light source emits light passing through a tube surface of the elongated tube shell. The tube surface for emitting light may be 360 degrees or less degrees. For example, 120 degrees of the tube shell may be disposed with a reflector while keeping 240 degrees of tube surface transparent or translucent for light to passing through to increase overall luminous efficacy.

The first power supply circuit converts the converted power of the working frequency to a first driving current supplying to the LED light source. In other words, the first power supply circuit helps to process power supply preprocessed by a ballast.

On the other hand, the second power supply circuit converts the external power of the industrial frequency to a second driving current to the LED light source, e.g. to process input power not handled by a ballast but from a raw power source.

In addition, the frequency switch circuit is connected to the first power supply and the second power supply for blocking one of the first power supply circuit and the second power supply to supply one of the first driving current and the second driving current to the LED light source according to an input frequency of a received power from the tube electrodes.

Specifically, the frequency switch circuit detects the frequency of the input power. By detecting and functioning different according to different frequencies, the frequency switch the first power supply circuit or the second power supply circuit to function. For example, the frequency switch may turn on the first power supply circuit and turn off the second power supply circuit to handle a power input previously processed by a ballast. The frequency switch may turn on the second power supply circuit and turn off the first power supply circuit to handle a power input not handled by a ballast but supplied directly from an indoor electricity power source.

The first power supply circuit, the second power supply circuit, and the detector are stored in the containing space for an elongated tube module.

In some embodiments, the frequency switch circuit may include a capacitor for blocking the received power into the first power supply circuit when the input frequency of the received power is within a predetermined range of the industrial frequency.

Capacitor components have a feature to block a signal when the signal is at a low frequency, e.g. 50 Hz, while passing the signal through if the signal is at a high frequency, like 45 KHz or a frequency higher than 20 KHz. For example, a capacitor of thin film capacitor with about 4.7 nF may be used. Other configuration or devices may be used if such components or circuit combination helps substantially passing through a signal in a first frequency range while substantially blocking a signal in a second frequency range.

In some embodiments, the frequency switch circuit may further include a voltage switch for supplying a voltage signal to the second power supply circuit to disable working of the second power supply circuit.

For example, the voltage switch may be an optical coupled switch connected to the first power supply circuit. The voltage switch is enabled when the first power supply is activated by receiving the received power. When the voltage switch is enabled, the voltage switch connects to a ground and may send a ground voltage to a power supply integrated chip of the second power supply circuit to disable working of the power supply integrated chip. In such case, since the second power supply circuit relies on the power supply integrated chip to generate a driving current to the LED light source, setting a pin of the power supply integrated chip with a ground voltage may disable function of the power supply integrated chip, thus blocking the function of the second power supply circuit, remaining only the first power supply circuit to drive the LED light source to emit light.

Please be noted that when an integrated chip is used, the signal sent to the integrated chip for disabling the integrated chip may be differently defined, e.g. not as a ground voltage but a 5V signal or other signal pattern. With such configuration, a corresponding adjustment to the frequency switch should be conducted accordingly, which would be understood by persons of ordinary skilled in the art and not repeated here for brevity.

In some embodiments, the elongated lamp tube may further include a safety circuit connected for turning off the second power supply circuit by detecting an impedance of tube electrodes. With such safety circuit, even users accidently touch the electrodes, users may not be hurt by high voltage electricity shock.

In some embodiments, the elongated lamp tube may further include a temperature fuss for escaping the first power supply circuit and the second power supply circuit from the received power if a temperature at the temperature fuss is higher than a predetermined threshold. For example, when there is any abnormal situation occurred, the temperature at the temperature fuss is quickly increased, and the temperature fuss may be disconnected, e.g. two metal clips, to prevent certain risk to happen.

In some embodiments, the elongated lamp tube may further include a tube detection module of resistors to be compatible with different types of ballast. Since there are various ballast design, such tube detection module composed of resistors may help ensure compatibility of the elongated lamp tube.

In some embodiments, the elongated lamp tube may further include a piezo-resistor for escaping the second power supply module from the received power when the received power is abnormal. For example, when sudden increasing voltage or current occurs the piezo-resistor may disconnect the circuit to prevent undesired risk.

In some embodiments, the first power supply circuit may have a first filter circuit for further filtering a bridge current generated by a bridge circuit to generate the first driving current to the LED light source. It is common to use a bridge circuit to convert alternating current to a direct current to drive LED modules. To further enhance stability of the driving current, a first filter circuit may be used to provide a more stable and less varied current, which may enhance overall light characteristic and enhance life span of LED modules.

In some embodiments, the first filter circuit may be made by combining a capacitor and a resistor connected in parallel with the LED light source.

In some embodiments, the second power supply circuit may have a second filter circuit with a conductor, a resistor and capacitors for lowering an electro-magnetic wave of the elongated lamp tube. When an alternating power source is used, it is important to prevent or at least lower down unnecessary electro-magnetic wave to satisfy various EMC standards particularly for light devices widely and frequently used in human life.

In some embodiments, the elongated lamp tube is compatible of replacing a fluorescent tube under Underwriters Laboratories (UL) standard. In other words, the elongated lamp tube as described is very suitable for replacing traditional UL fluorescent tubes both for lamp fixtures with or without ballast devices.

In some embodiments, the first power supply circuit, the second power supply circuit and the frequency switch circuit are stored in one of the caps. As mentioned above, the first power supply circuit, the second power supply circuit, the frequency switch circuit and the LED light source are stored in the containing space of the tube shell. Furthermore, the two caps attached at two opposing ends of the tube shells may provide a place even better for storing the first power supply circuit, the second power supply circuit and the frequency switch circuit. These circuits may be partly stored in one cap and partly in the other cap, or all stored in one of the caps.

In some embodiments, the industrial frequency mentioned above is between 30 to 70 Hz. In addition, the working frequency of the ballast may be like 45 KHz or a frequency higher than 20 KHz.

In some embodiments, the ballast is an electronic ballast. Please be noted that other ballast type may also be used. The electronical ballast for converting input power to a high frequency is particularly fitting to the embodiment.

In another embodiment series, a ballast may be designed. The ballast is designed to work with a lamp fixture to be installed with an elongated lamp tube. The elongated lamp tube includes an elongated tube shell having a containing space and two shell ends, two caps respectively fixed to the two shell ends, the two caps having tube electrodes, a LED light source for emitting light passing through a tube surface of the elongated tube shell, and a second power supply circuit. The ballast has a housing, electrodes and a wire.

The housing may be similar to traditional ballast under various standards. The electrodes are disposed on the housing compatible with ballast electrodes under UL standard for receiving a power of an industrial frequency. The wire in the housing is provided for routing the power of the industrial frequency to the tube electrodes electrically connected to the second power supply circuit without changing the industrial frequency of the power. In other words, the ballast does not work like traditional ballast devise. Instead the ballast may simply pass the input power to the elongated lamp tube as described above, since such elongated lamp has a second power supply circuit capable of processing raw power input, like 120V-277V power with 50 Hz or 60 Hz.

Still, by using the ballast, the elongated lamp tube, originally may not fit the lamp fixture with a ballast, now works normally with such lamp fixture. Since such elongated lamp tube may handle raw power source of 120V-277V with 50 Hz or 60 Hz while still be compatible installed on a lamp fixture with a ballast, the first power supply circuit may exist or may not need to exist at the same time, since the second power supply circuit is sufficient in such case.

Even so, please be noted that the elongated lamp tube may still encompass the first power supply circuit and the frequency switch as mentioned above.

On making such embodiments as a product, the elongated lamp tube and the special ballast may be sold as a kit.

In such case, users may buy the kit home. When their old ballast still works, the elongated lamp tube may work well with the old ballast since the elongated lamp tube has the first power supply circuit. When the old ballast is out of order, the user may replace the old ballast with the special ballast as mentioned above and uses the elongated lamp tube directly since the elongated lamp tube has the second power supply circuit and the frequency switch circuit to automatically turn on the second power supply circuit to function normally.

In other words, these embodiments provide a convenient technical solutions for users no matter they user a lamp fixture with a ballast or without a ballast. This is even particularly helpful for manufacturers because overall stocking pressure is dramatically decreased with such compatibility.

In addition to the above-described embodiments, various modifications may be made, and as long as it is within the spirit of the same invention, the various designs that can be made by those skilled in the art are belong to the scope of the present invention.

The invention claimed is:

1. An elongated lamp tube, comprising:

an elongated tube shell, having a containing space and two shell ends;

two caps respectively fixed to the two shell ends, the two caps having tube electrodes capable of being electrically connecting to first electrodes of a first type lamp fixture without a ballast or second electrodes of a second type lamp fixture with a ballast, the ballast converting an external power of an industrial frequency to a converted power of a working frequency higher than a frequency of the external power;

a LED light source for emitting light passing through a tube surface of the elongated tube shell;

a first power supply circuit for converting the converted power of the working frequency to a first driving current supplying to the LED light source;

a second power supply circuit for converting the external power of the industrial frequency to a second driving current to the LED light source; and a frequency switch circuit connected to the first power supply and the second power supply for blocking one of the first power supply circuit and the second power supply to supply one of the first driving current and the second driving current to the LED light source according to an input frequency of a received power from the tube electrodes, wherein the first power supply circuit, and the second power supply circuit are stored in the containing space, wherein the frequency switch circuit comprises a capacitor for blocking the received power into the first power supply circuit when the input frequency of the received power is within a predetermined range of the industrial frequency, and wherein the frequency switch circuit further comprises a voltage switch for supplying a voltage signal to the second power supply circuit to disable working of the second power supply circuit.

2. The elongated lamp tube of claim 1, wherein the voltage switch is an optical coupled switch connected to the first power supply circuit enabled when the first power supply is activated by receiving the received power for sending a ground voltage to a power supply integrated chip of the second power supply circuit to disable working of the power supply integrated chip.

3. The elongated lamp tube of claim 1, further comprising a safety circuit connected for turning off the second power supply circuit by detecting an impedance of tube electrodes.

4. The elongated lamp tube of claim 1, further comprising a temperature fuss for escaping the first power supply circuit and the second power supply circuit from the received power if a temperature at the temperature fuse is higher than a predetermined threshold.

5. The elongated lamp tube of claim 1, further comprising a tube detection module of resistors to be compatible with different types of ballast.

6. The elongated lamp tube of claim 1, further comprising a piezo-resistor for escaping the second power supply module from the received power when the received power is abnormal.

7. The elongated lamp tube of claim 1, wherein the first power supply circuit has a first filter circuit for further filtering a bridge current generated by a bridge circuit to generate the first driving current to the LED light source.

8. The elongated lamp tube of claim 7, wherein the first filter circuit has a capacitor and a resistor connected in parallel with the LED light source.

9. The elongated lamp tube of claim 1, wherein the second power supply circuit has a second filter circuit with a conductor, a resistor and capacitors for lowering an electromagnetic wave of the elongated lamp tube.

10. The elongated lamp tube of claim 1, wherein the elongated lamp tube is compatible of replacing a fluorescent tube under Underwriters Laboratories (UL) standard.

11. The elongated lamp tube of claim 1, wherein the first power supply circuit, the second power supply circuit and the frequency switch circuit are stored in one of the caps.

12. The elongated lamp tube of claim 1, wherein the industrial frequency is between 30 to 70 Hz.

13. The elongated lamp tube of claim 1, wherein the working frequency of the ballast is between 20 KHz and 100 KHz.

14. The elongated lamp tube of claim 1, wherein the ballast is an electronic ballast.

* * * * *